US005298382A

United States Patent [19]

Toyoda et al.

[11] Patent Number: 5,298,382

[45] Date of Patent: Mar. 29, 1994

[54] PROCESSING OF PHOTOGRAPHIC SILVER HALIDE PHOTOSENSITIVE MATERIAL AND FIXER USED THEREIN

[75] Inventors: Takashi Toyoda; Itsuo Fujiwara, both of Kanagawa, Japan

[73] Assignee: Fuji Photo Film Co., Ltd., Kanagawa, Japan

[21] Appl. No.: 22,105

[22] Filed: Feb. 25, 1993

[30] Foreign Application Priority Data

Feb. 26, 1992 [JP] Japan ..... 4-75206

[51] Int. Cl.[5] ..... G03C 1/73

[52] U.S. Cl. ..... 430/539; 430/363; 430/453; 430/458; 430/642; 430/963

[58] Field of Search ..... 430/401, 427, 453, 455, 430/458, 363, 531, 533, 539, 628, 639, 440, 641, 642, 363, 537, 963

[56] References Cited

U.S. PATENT DOCUMENTS

| | | | |
|---|---|---|---|
| 2,195,405 | 4/1940 | Brubaker | 430/458 |
| 4,266,010 | 5/1981 | Nagatomo et al. | 430/355 |
| 4,444,873 | 4/1984 | Ishikawa et al. | 430/455 |
| 5,116,722 | 5/1992 | Callant et al. | 430/363 |
| 5,206,120 | 4/1993 | Hayashi | 430/377 |

FOREIGN PATENT DOCUMENTS 3-168741 7/1991 Japan .

*Primary Examiner*—Hoa Van Le

*Attorney, Agent, or Firm*—Sughrue, Mion, Zinn, Macpeak & Seas

[57] ABSTRACT

Photographic silver halide photosensitive material is processed, after exposure, by treating it with a working fixer solution. The photosensitive material comprises at least one layer of silver halide emulsion on a support and contains at least 10% by weight, based on gelatins, of a gelatin having an isoelectric point of at least 5.0 on the emulsion layer side. The working fixer solution is prepared by furnishing a fixer concentrate of at least pH 5 containing a thiosulfate as a fixing agent, 0.05–0.8 mol/liter of a sulfite and up to 0.01 mol/liter of a water-soluble aluminum salt, and diluting the fixer concentrate with water, thereby forming the working fixer solution containing a minimized amount of ammonium thiosulfate and 0.5–2.5 mol/liter of sodium thiosulfate. The method provides improved rapid processing with increased degrees of fixation and drying while preventing the generation of sulfurous acid and ammonia gases.

4 Claims, 1 Drawing Sheet

PROCESSING OF PHOTOGRAPHIC SILVER HALIDE PHOTOSENSITIVE MATERIAL AND FIXER USED THEREIN

BACKGROUND OF THE INVENTION

1. Field of the Invention

This invention relates to a method for processing photographic silver halide photosensitive material which is often abbreviated as photosensitive material, hereinafter, more particularly, to such a processing method adapted for rapid processing and ensuring ease of handling. It also relates to a fixer used in the method.

2. Prior Art

The current developing process of photographic silver halide photosensitive material is advancing toward rapid processing by automatic processors for further improvements in operating efficiency. In parallel with such advances, there are increasing demands for improving the working environment and facilitating the maintenance of processor accessories.

For example, conventional acidic hardening fixer solutions are used as running equilibrium solutions at pH 4.3 to 4.90 and thus inevitably give off sulfurous acid and acetic acid gases. These gases detrimentally affect the working environment and can cause corrosion of automatic processor accessories, inviting a failure.

The fixer can be increased in pH by increasing the film hardness of photosensitive material and allowing the aluminum salt hardener to be removed from the fixer. One such fixer is disclosed in Japanese Patent Application Kokai (JP-A) No. 168741/1991. These fixers, however, are not devoid of the odor problem because although generation of sulfurous acid and acetic acid gases is fairly suppressed, more amounts of ammonia gas can generate.

Anmonia gas is generated primarily from the fixer itself and partially from a fraction of the developer carried over by the photosensitive material. In particular, the rapid processing uses ammonium thiosulfate as the fixing agent, which forms a main origin from which ammonia generates. Thus it is difficult to avoid ammonia generation in rapid processing. The ammonia gas not only raises an odor problem, but is also reactive with sulfurous acid gas in air, depositing white crystals of ammonium sulfate within the processor, which can cause failure.

As previously mentioned, increasing the pH of fixer results in increased water contents of photosensitive material after water washing which significantly affect drying efficiency. Then the fixer pH increase is undesirable particularly for rapid processing.

There is a need for a processing method adapted for rapid processing which can eliminate an odor problem and facilitate the maintenance of the processor.

SUMMARY OF THE INVENTION

A primary object of the present invention is to provide a method for processing photographic silver halide photosensitive material which is adapted for rapid processing, uses a fixer free of an odor problem and achieves effective fixation and drying.

A second object of the present invention is to provide a fixer which is free of an odor problem and achieves effective fixation.

According to the present invention, there is provided a method for processing a photographic silver halide photosensitive material after exposure comprising the step of treating the material with a working fixer solution. The photosensitive material has at least one layer of silver halide emulsion on a support and contains at least 10% by weight of a gelatin having an isoelectric point of at least 5.0 on the same side thereof as the emulsion layer with respect to the support, in percent by weight of gelatins on the emulsion layer side. The working fixer solution is prepared by furnishing a fixer concentrate of at least pH 5 containing a thiosulfate as a fixing agent, 0.05 to 0.8 mol/liter of a sulfite and up to 0.01 mol/liter of a water-soluble aluminum salt, and diluting the fixer concentrate with water at a volume ratio of water to the concentrate of at least 0.5/1, thereby forming the working fixer solution containing up to 0.1 mol/liter, preferably free of ammonium thiosulfate and 0.5 to 2.5 mol/liter of sodium thiosulfate.

In one preferred embodiment, the photosensitive material has at least one layer of a silver halide emulsion which contains silver halide grains having a mean equivalent spherical diameter of up to 0.6 μm, is sensitive to radiation in the wavelength range of 600 to 800 nm, and adapted to be exposed to a light source in the form of a semiconductor laser.

Preferably the processing method of the invention is carried out in an automatic processor including a developing tank, a fixing tank, a washing tank, a first rinsing tank between the developing and fixing tanks, and a second rinsing tank between the fixing and washing tank.

BRIEF DESCRIPTION OF THE DRAWING

The only figure.

DETAILED DESCRIPTION OF THE INVENTION

Figure 1:
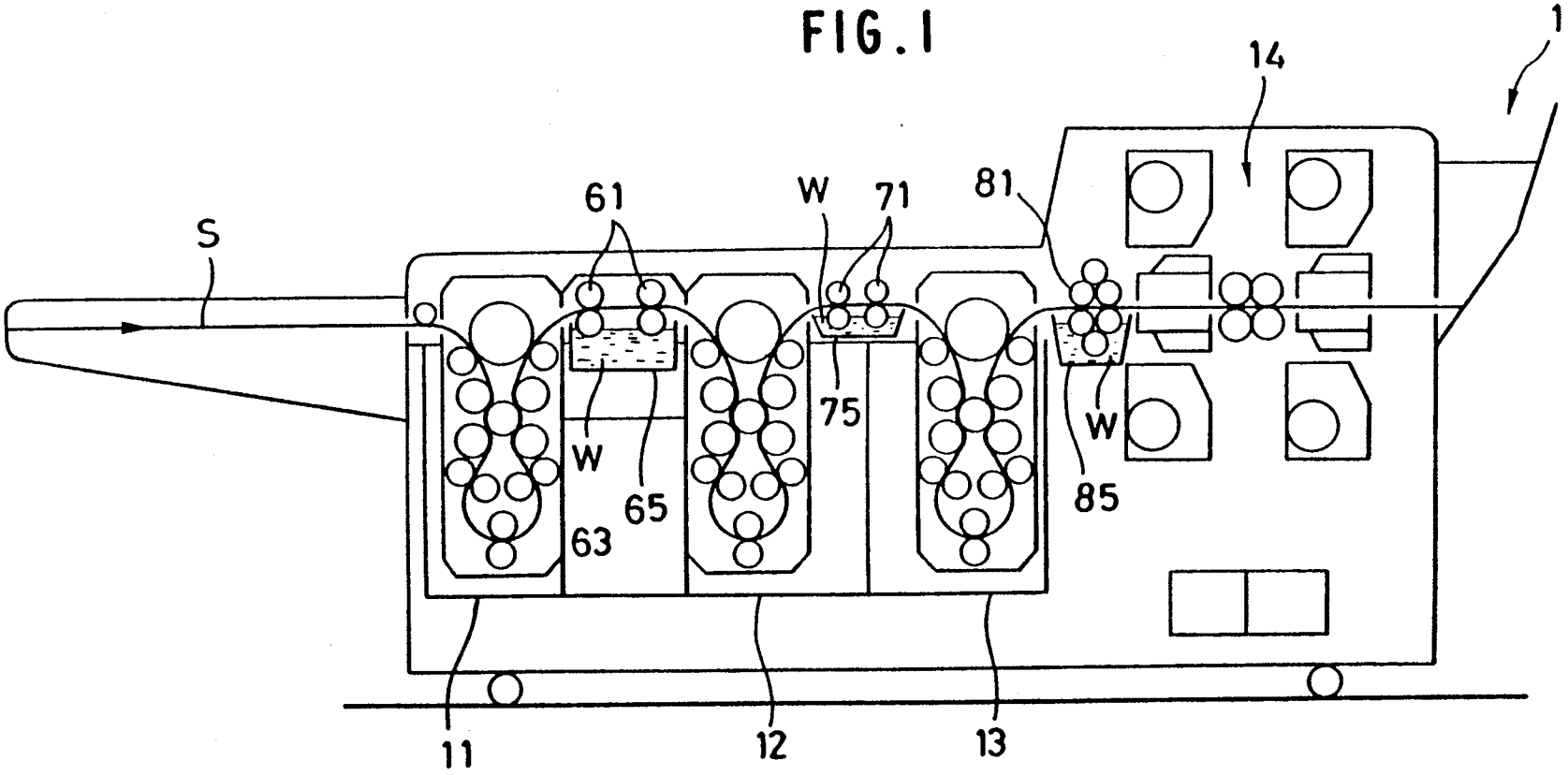
FIG. 1 is a schematic elevational view of one exemplary automatic processor used in the present invention.

In the present disclosure, the fixer is also referred to as working fixer solution particularly when described in the context of processing method. The fixer contains a thiosulfate as a fixing agent and is prepared for processing by furnishing a fixer concentrate and diluting the concentrate with water. Among thiosulfates, sodium thiosulfate is used as a predominant fixing agent. The working fixer solution contains 0.5 to 2.5 mol/liter, preferably 0.5 to 2 mol/liter, more preferably 0.7 to 1.5 mol/liter of sodium thiosulfate. This range of sodium thiosulfate content provides an adequate fixing speed for rapid processing. Outside the range, the fixing speed is low.

The working fixer solution also contains up to 0.1 mol/liter, preferably up to 0.05 mol/liter of ammonium thiosulfate. More preferably, the ammonium thiosulfate content is substantially zero, that is, the fixer is substantially free of ammonium thiosulfate. The minimized ammonium thiosulfate content offers a substantially ammonia-free fixer and is effective for preventing emission of ammonia gas during photosensitive material processing.

One preferential practice in the prior art is to use fixers containing an ammonium thiosulfate fixing agent for rapid processing because ammonium thiosulfate has a higher fixing speed than sodium thiosulfate and can maintain a sufficient fixing speed even after the fixer is somewhat exhausted by processing a certain quantity of photosensitive material. The ammonium thiosulfate, however, can undesirably generate ammonia gas during processing and suffers from an environmentally undesirable problem that the fixer is carried by the photosensitive material to the subsequent washing tank, resulting in nitrogenous compounds building up in washing water drainage. The fixer of the present invention eliminates these problems.

The working fixer solution is prepared by diluting a fixer concentrate with water at a water/concentrate volume ratio of at least 0.5/1, preferably from 0.5/1 to 3.0/1, more preferably from 0.5/1 to 2.0/1. The concentrate has a pH value of at least 5.0, preferably 5.5 to 8.8. Within these ranges of water dilution and pH, the fixer concentrate remains stable during storage. Particularly, pH values of 5.0 or higher allow the solution (or concentrate) to have a higher concentration, substantially eliminate generation of acidic gases such as sulfurous acid and acetic acid gases, and prevent sulfidation due to decomposition of thiosulfates.

Sodium thiosulfate has the drawbacks that it has a lower solubility than ammonium thiosulfate and is thus difficult to prepare a solution of higher concentration and the concentrate is susceptible to sulfidation with the lapse of time. Further, conventional acidic hardening fixers suffer from the problem of acidic gases such as sulfurous acid and acetic acid gases giving off. These problems are overcome by the present invention as mentioned above.

For increasing the concentration and shelf stability of the fixer concentrate, the fixer concentrate should preferably contain 0.05 to 0.8 mol/liter, more preferably 0.1 to 0.5 mol/liter of a sulfite and up to 0.01 mol/liter, more preferably up to 0.005 mol/liter of a water-soluble aluminum salt. Most preferably the aluminum salt content should be zero.

The sulfite is used in the fixer as a preservative and its examples are the same as commonly used in the developer, with sodium sulfite being preferred.

The water-soluble aluminum salt is used in the fixer as a hardener and includes aluminum chloride, aluminum sulfate and potassium alum, with aluminum sulfate being preferred.

In addition to the above-mentioned components, the fixer may further contain pH buffer agents (e.g., acetic acid and boric acid), pH adjusting agents (e.g., ammonia and sulfuric acid), chelating agents, surfactants, wetting agents, fixation accelerators, and the like, if desired.

Examples of the surfactant used herein include anionic surfactants such as hydrogen sulfates and sulfonates, polyethylene series surfactants, and ampholytic surfactants as described in JP-A 6840/1982. Any of well-known defoaming agents may also be added. Examples of the wetting agent include alkanol amines and alkylene glycols (e.g., ethylene glycol, diethylene glycol, triethylene glycol and glycerin). Examples of the fixation accelerator include thiourea derivatives as described in JP-B 35754/1970, 122535/1983 and 122536/1983, alcohols having a triple bond in a molecule, and thioether compounds as described in U.S. Pat. No. 4,126,459. Examples of the pH buffer agent include organic acids such as acetic acid, malic acid, succinic acid, tartaric acid and citric acid, and inorganic buffer agents such as boric acid, phosphates and sulfites, with the inorganic buffer agents being preferred for preventing odor and processor part rusting.

Using the fixer defined above, the processing method of the present invention is carried out on a photographic silver halide photosensitive material having at least one layer of silver halide emulsion on a support. The photosensitive material contains, in percent by weight of gelatins on the emulsion layer side of the photosensitive material, at least 10%, preferably 10 to 60% of a specific gelatin on the same side thereof as the emulsion layer with respect to the support. The gelatin used herein should have an isoelectric point of at least 5.0, preferably 5.0 to 10.0. The presence of at least 10% by weight of a gelatin having an isoelectric point of at least 5.0 on the emulsion layer side ensures that the photosensitive material is efficiently dried after it is processed with a high pH fixer according to the present invention.

The present invention eliminates the problem associated with conventional high pH fixers that they adversely affect the subsequent drying step although they can minimize odor and other problems. The advantages of the present invention including elimination of the fixer odor problem and improvements in fixation and drying are obtained only when the fixer defined herein is combined with the photosensitive material defined herein.

The term "isoelectric point" refers to the pH of a gelatin solution which is completely removed of salt ions, that is, isoionic point. The gelatin having an isoelectric point of at least 5.0 is generally acid treated gelatin and commercially available as #950 from Nitta K. K., #PS and #ABA from Nippi K. K.

Insofar as the gelatin having an isoelectric point of at least 5.0 is present in an amount of 10% by weight or more of the total gelatin weight, any gelatin having an isoelectric point of less than 5.0 may be co-present on the emulsion layer side.

Where any hydrophilic binder layer such as a back layer is provided on the rear side of the support, such rear side layers need not use a gelatin having an isoelectric point of at least 5.0 and may rather use a gelatin having an isoelectric point of less than 5.0 in view of the effective preparation of photosensitive material. It is preferred to use a gelatin having an isoelectric point of at least 5.0 in a surface protective layer and a gelatin having an isoelectric point of less than 5.0 in an emulsion layer both on the same side of the support. For the emulsion layer, alkali-treated gelatin is rather preferred in view of photographic properties (sensitivity and gamma value).

The photosensitive material after imagewise exposure is developed with a developer prior to fixation with the fixer defined above. The developer contains a developing agent, preservative, alkaline agent and other conventional agents as will be described later. The developing agent is preferably a combination of dihydroxybenzene and 1-phenyl-3-pyrazolidone or a combination of dihydroxybenzene and p-aminophenol for better performance. The hydroquinones may be replaced by ascorbic acid analogs.

Examples of the dihydroxybenzene developing agent used herein include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone, with the hydroquinone being preferred. Examples of the p-aminophenol developing agent used herein include N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol, with the N-methyl-p-aminophenol being preferred. Examples of the 1-phenyl-3-pyrazolidone developing agent used herein include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone. The developing agent is generally used in an amount of about 0.01 to 1.2 mol/liter.

The sulfite preservative in the developer includes sodium sulfite, potassium sulfite, lithium sulfite, ammonium sulfite, sodium bisulfite, and potassium metabisulfite. The sulfite is generally used in an amount of at least about 0.2 mol/liter, especially at least 0.4 mol/liter. The preferred upper limit is 2.5 mol/liter.

The developer is preferably at pH 9 to 13, especially pH 9.5 to 12. Alkaline agents are used for pH adjustment. Included are water-soluble inorganic alkali metal salts such as sodium hydroxide, potassium hydroxide, sodium carbonate, potassium carbonate, sodium tertiary phosphate, and potassium tertiary phosphate.

Buffer agents are also useful, for example, borates as disclosed in JP-A 186259/1981, saccharides (e.g., saccharose), oximes (e.g., acetoxime), phenols (e.g., 5-sulfosalicylic acid), tertiary phosphates (e.g., sodium and potassium salts), and carbonates as disclosed in JP-A 93433/1985.

Also used in the developer are dialdehyde hardening agents including dialdehydes and bisulfite salt adducts thereof. Examples include glutaraldehyde, α-methylglutaraldehyde, β-methylglutaraldehyde, maleindialdehyde, succindialdehyde, methoxysuccindialdehyde, methylsuccindialdehyde, α-methoxy-β-butoxyglutaraldehyde, α-n-buthoxysuccindialdehyde, α,α-dimethoxysuccindialdehyde, α,α-didiethylsuccindialdehyde, β-isopropyisuccindialdehyde, butylmaleindialdehyde or bisulfate salt adducts thereof. The dialdehyde hardening agent is preferably used in an amount of 2.0 to 95 grams, especially 2 to 10 grams per liter of the developer.

Additives used other than the above-mentioned components include development retarders such as sodium bromide and potassium bromide; organic solvents such as ethylene glycol, diethylene glycol, triethylene glycol and dimethylformamide; and antifoggants, for example, mercapto compounds such as 1-phenyl-5-mercaptotetrazole and 2-mercaptobenzimidazole, and indazole compounds such as 5-nitroindazole, and benzotriazole compounds such as 5-methylbenzotriazole. Also added are development promoters as disclosed in Research Disclosure, Vol. 176, No. 17643, Item XXI (December 1978), and if desired, color toning agents, surfactants, defoaming agents, and water softeners. Anti-silver-sludging agents may be added to the developer, for example, the compounds described in JP-A 24347/1981 and Japanese Patent Application No. 187700/1989. To the developer may be added amino compounds, for example, alkanol amines as described in EP-A 01 36 582, UK Patent No. 958,678, U.S. Pat. No. 3,232,761, and JP-A 106244/1981. Other useful additives are described in L. F. A. Mason "Photographic Processing Chemistry," Focal Press (1966), pages 226–229; U.S. Pat. Nos. 2,193,015 and 2,592,364, and JP-A 64933/1973.

In the practice of the present invention, washing water, stabilizing solution and the like are also used in addition to the developer and fixer. For these processing solutions, reference is made to JP-A 168741/1991.

The processing method of the present invention is adapted for rapid processing-and generally includes a series of developing, fixing, washing and drying steps.

In the practice of the invention, the developing time generally ranges from 5 seconds to 1 minute, preferably from 5 to 30 seconds while the developing temperature ranges from 25° to 50° C., preferably from 25° to 40° C. The fixing time generally ranges from 5 seconds to 1 minute at temperatures of about 20° to 50° C., preferably from 5 to 30 seconds at temperatures of about 25° to 40° C. For water washing or stabilizing bath, the time generally ranges from 3.5 seconds to 1 minute at temperatures of 0° to 50° C., preferably from 3.5 to 30 seconds at temperatures of 15° to 40° C.

Having finished development, fixation and washing (or stabilization), the photosensitive material is removed of the wash water, that is, squeezed of water through squeeze rollers and then dried. Drying is generally at about 40° to 100° C. The drying time may vary with the ambient condition, usually in the range of from about 5 seconds to 1 minute, preferably from about 5 to 30 seconds at 40° to 80° C.

Several terms are defined in conjunction with a sequence of successively processing a length or sheet of photosensitive material through a developing tank, a fixing tank, a washing tank, and then a drying section of an automatic processor. "Developing process time" or "developing time" is a duration taken from the point when the leading edge of a photosensitive material is dipped in the developing tank liquid in a processor to the point when it is subsequently dipped in the fixer. "Fixing time" is a duration taken from the point when the leading edge is dipped in the fixing tank liquid to the point when it is dipped in the washing tank liquid (or stabilizer). "Washing time" is a duration when the photosensitive material is dipped in the washing tank liquid. "Drying time" is a duration when the photosensitive material passes through the processor drying section where hot air at 35° to 100° C., preferably 40° to 80° C. is usually blown.

Referring to FIG. 1, there is illustrated one preferred arrangement of the automatic-processor used herein. The illustrative processor is of the roller transfer type using rollers for passing forward a sheet of photosensitive material along a path. As shown in FIG. 1, the processor 1 includes within a housing, a developing tank 11, a fixing tank 12, and a washing tank 13, which are filled with developer, fixer and washing solution, respectively. A sheet of photosensitive material S is fed along a serpentine path (shown by the arrowed solid line) to enter the respective tank solutions in sequence. Disposed downstream of the washing tank 13 are a cleaning tank 85 with squeeze rollers 81 and a drying section 14 for drying the photosensitive material S.

Disposed between the developing and fixing tanks 11 and 12 are two pairs of cross-over rollers 61 for transferring the photosensitive material S from the developing tank 11 to the fixing tank 12. Disposed below the cross-over rollers 61 is a rinsing tank 65 filled with rinsing water W. Since the cross-over rollers 61 are at least partially immersed in rinsing water W, they also serve as rinsing rollers. Then the cross-over rollers 61 serve not only to move the photosensitive material S forward, but also to clamp the material therebetween to remove the entraining developer from the material, thereby minimizing the carry-over of the developer to the fixing tank. Then, the arrangement of cross-over rollers 61 and rinsing tank 65 as illustrated in the FIGURE is effective for preventing ammonia gas from generating due to the carry-over of the developer to the fixing tank and thus advantageous for attaining the objects of the present invention.

Also disposed between the fixing and washing tanks 12 and 13 are two pairs of cross-over rollers 71 for transferring the photosensitive material S from the fixing tank 12 to the washing tank 13. Disposed below the crossover rollers 71 is a rinsing tank 75 filled with rinsing water W. The cross-over rollers 71 are at least partially immersed in rinsing water W. Like the above-mentioned cross-over rollers 61, the arrangement of cross-over rollers 71 and rinsing tank 75 is advantageous for attaining the objects of the present invention since it is effective for preventing the fixer from being carried over by the photosensitive material S to the washing water, reducing the washing load and improving drying efficiency.

The processor used in the present invention is not limited to the arrangement shown in FIG. 1. Any desired design can be employed insofar as rinsing tanks having the same function as above are disposed between the developing and fixing tanks and between the fixing and washing tanks, respectively.

Now the photosensitive material is again described in detail.

The photographic silver halide photosensitive material has at least one layer of a silver halide emulsion as a photosensitive component on a support. Preferably the emulsion contains silver halide grains having a mean equivalent spherical diameter of up to 0.6 μm, more preferably up to 0.5 μm, most preferably 0.45 to 0.2 μm. This emulsion is sometimes referred to as a "fine grain emulsion".

The emulsion layer containing the fine grain emulsion is sensitive to radiation in the wavelength range of 600 to 800 nm, that is, having a photosensitive region of 600 to 800 nm, and can be exposed to a light source in the form of a semiconductor laser.

With regard to the photosensitive material adapted for laser exposure, more rapid processing is desired in these days. For rapid processing, development, fixation and washing should be completed within a short time. The fine grain emulsion is best suited to this end.

The silver halide grains in the fine grain emulsion may have either a regular crystal shape such as cubic, octahedral and tetradecahedral (14-sided) or an irregular crystal shape such as spherical, plate and potato. Mixtures of various crystal shape grains are also useful.

The fine grain emulsion should preferably contain at least 5%, especially at least 70% based on the projected area of grains having a mean equivalent spherical diameter of up to 0.6 μm.

Iridium ion may be contained in the fine grain emulsion. To this end, a water-soluble iridium compound such as hexachloroiridate (IV) is often added in the form of an aqueous solution during the preparation of the silver halide emulsion. The iridium compound may be added in aqueous solution form like silver salt and halide solutions used for silver halide grain formation and at any time during the silver halide grain forming procedure covering prior to, during and after grain formation. Preferably, it is added during grain formation. Iridium ion may be present in an amount of $10^{-8}$ to $10^{-5}$ mol, especially $10^{-7}$ to $10^{-6}$ mol per mol of silver halide.

The silver halide in the emulsion may have any desired composition including salts of silver with chlorine, bromine and/or iodine, such as silver bromide, silver chloride, silver iodobromide, silver chlorobromide, and silver chloroiodobromide. The silver iodobromide and silver chloroiodobromide may contain 0 to 3 mol %, preferably 0 to 1 mol % of silver iodide and 0 to 50 mol %, preferably 0 to 30 mol % of silver chloride. The silver chlorobromide may contain 0 to 98 mol %, preferably 20 to 95 mol % of silver chloride.

In the practice of the present invention, a monodisperse emulsion is often used as the emulsion. Such a monodisperse emulsion may be prepared by accelerating the rate of addition of silver nitrate and water soluble halide solutions as silver halide grains grow. The accelerated addition rate is effective for rendering the grain size distribution more monodisperse and reducing the addition time, offering an advantage in commercial manufacture. It is also advantageous in that the occasion for structural defects to form within silver halide grains is minimized.

As disclosed in JP-B 36890/1973, 16364/1977 and JP-A 142329/1980, the addition rate may be accelerated by continuously or stepwise increasing the rate of addition of silver salt and halide aqueous solutions. The upper limit of the addition rate may be the flow rate above which new grains can form and its value varies with temperature, pH, pAg, degree of agitation, the composition, solubility, diameter and grain-to-grain distance of silver halide grains, the type and concentration of protective colloid or the like.

It is well known in the art how to prepare monodisperse emulsions, for example, the techniques described in J. Phot. Sci., 12, 242–251 (1963), JP-B 36890/1973 and 16364/1977, JP-A 142329/1980 and 179835/1982.

The silver halide emulsions used herein may also be core/shell type monodisperse emulsions which are well known from JP-A 48521/1979 and the like.

Where a multi-dispersed emulsion is used as the emulsion in the practice of the present invention, preparation of such a multi-dispersed emulsion may be in accord with well-known techniques. It may be prepared by the neutral, acidic, ammoniacal, forward mixing, reverse mixing, double jet, controlled double jet, conversion and core/shell techniques as described in the literature, for example, T. H. James, "The Theory of the Photographic Process", 4th Ed., Macmillan (1977), pages 88–104.

In the photographic silver halide photosensitive material according to the present invention, the coverage of silver coated is up to 5 grams, especially 1 to 4 grams per square meter on one surface of the support.

Preferably the emulsion used in the present invention is a monodisperse emulsion. The monodisperse emulsion is an emulsion having such a particle size distribution that the coefficient of variation $S/\bar{r}$ associated with the size of silver halide grains is up to 0.25 wherein $\bar{r}$ is an average grain size and S is the standard deviation relating to the grain size. Provided that individual emulsion grains have a size ri and their number is ni, the average grain size $\bar{r}$ and standard deviation S are defined as follows.

$$r = \frac{\Sigma ni \cdot ri}{\Sigma ni}$$

$$S = \sqrt{\frac{\Sigma (r - ri)^2 \cdot ni}{\Sigma ni}}$$

The size of individual grains used in this definition is a projected area equivalent diameter corresponding to the projected area of grains in a microphotograph obtained when a silver halide emulsion is microscopically imaged by a well-known technique, most often microscopic photography as described in T. H. James, "The Theory of the Photographic Process", 3rd Ed., Macmillan (1966), pages 36–43. As described therein, the projected area equivalent diameter of silver halide grains is defined as the diameter of circles equal to the projected area of silver halide grains. Therefore, for those silver halide grains having a shape other than sphere, for example, cubic, octahedral, tetradecahedral, plate and potato-like shape, the average grain size $\bar{r}$ and its standard deviation S can be determined in the same manner as above.

The coefficient of variation $S/\bar{r}$ associated with the size of silver halide grains is preferably up to 0.25, more preferably up to 0.20, most preferably up to 0.15.

In the silver halide emulsion according to the present invention, there may be used various dyes for spectral sensitization, for example, tricarbocyanine dyes and 4-quinoline nucleus-containing dicarbocyanine dyes as described in JP-A 89838/1988, cyanine dyes, merocyanine dyes and mixtures thereof. The spectral sensitizing dye is generally added to the silver halide emulsion in an amount of $10^{-7}$ to $10^{-2}$ mol, preferably $10^{-6}$ to $10^{-3}$ mol per mol of silver halide.

The spectral sensitizing dye may be directly dispersed into the emulsion. Alternatively, it is dissolved in a suitable solvent such as methyl alcohol, ethyl alcohol, methyl cellosolve, acetone, water, pyridine or mixed solvent before the solution is added to the emulsion. The dye is often added after chemical sensitization although it may also be added during grain formation or before chemical sensitization. Ultrasonic agitation will help dissolution.

For adding the dye to the emulsion, such techniques as disclosed in U.S. Pat. Nos. 2,912,343, 3,342,605, 2,996,287 and 3,429,935 may also be employed. Moreover, the spectral sensitizing dye may be uniformly dispersed in the silver halide emulsion just before coating on a suitable support although it can be dispersed at any stage in the silver halide emulsion preparation process.

In the practice of the present invention, other sensitizing dyes may also be used. Such dyes include spectral sensitizing dyes as described in U.S. Pat. Nos. 2,688,545, 3,397,060, 3,416,927, 3,615,613, 3,615,632, 3,615,635, 3,617,295, 3,628,964, 3,635,721, and 3,703,377, UKP 1,242,588 and 1,293,862, JP-B 4930/1968, 4936/1968, 10773/1968 and 14030/1969, and combinations of these dyes with infrared sensitizing dyes.

In combination with the aforementioned sensitizing dyes, the compounds described in JP-A 89838/1988 may be used for further enhancing sensitization effect, that is, supersensitization.

Furthermore, along with the aforementioned sensitizing dyes, storage improvers as described in JP-A 89838/1988 may be used in an amount of about 0.01 to 5 grams per mol of silver halide in the emulsion.

The supersensitizer and storage improver used herein may be directly dispersed into the emulsion. Alternatively, they are dissolved in a suitable solvent such as methyl alcohol, ethyl alcohol, propanol, methyl cellosolve, and acetone, or mixed solvent before the solution is added to the emulsion. Otherwise, they can be added in the form of a dispersion in a solvent or colloid in accordance with conventional sensitizing dye addition techniques.

The supersensitizer and storage improver may be added to the emulsion either prior to or subsequent to the spectral sensitizing dye. They may be dissolved separately from the spectral sensitizing dye and separately added to the emulsion at the same time or mixed together before addition to the emulsion.

The photosensitive material used in the present invention includes another photographic emulsion layer or hydrophilic colloid layer which may contain various surfactants for various purposes including coating aids, antistatic, slippage improvement, emulsion dispersion, antisticking and improving photographic properties (development acceleration, contrast increase, sensitization, etc.). The preferred surfactants for antistatic purpose include fluorinated surfactants and polymers as described in U.S. Pat. No. 4,201,586, JP-A 74554/1984, 80849/1985, 249021/1985, and 32462/1986; anionic surfactants as described in JP-A 76742/1985, 80839/1985, 80846/1985, 80848/1985, 76741/1985, 208743/1985 and Japanese Patent Application Nos. 13398/1986, 16056/1986 and 32462/1986; and conductive polymers and latexes (nonionic, anionic, cationic and ampholytic) as described in JP-A 204540/1982 and Japanese Patent Application No. 32462/1986. Inorganic antistatic agents include conductive tin oxide, zinc oxide and composite oxides in which these oxides are doped with antimony or the like as described in JP-A 118242/1982.

Examples of the hardener used herein include aldehydes such as mucochloric acid, mucobromic acid, mucophenoxychloric acid, mucophenoxybromic acid, formaldehyde, dimethylol urea, trimethylol melamine, glyoxazole, monomethylglyoxazole, 2,3-dihydroxy-1,4-dioxane, 2,3-dihydroxy-5-methyl-1,4-dioxane, succinaldehyde, 2,5-dimethoxytetrahydrofuran, and glutaraldehyde; active vinyl compounds such as divinylsulfone, methylenebismaleimide, 5-acetyl-1,3-diacryloyl-hexahydro-s-triazine, 1,3,5-triacryloyl-hexahydro-s-triazine, 1,3,5-trivinylsulfonylhexahydro-s-triazine, bis(-vinylsulfonylmethyl) ether, and 1,3-bis(vinylsulfonylmethyl)propanol-2-bis(α-vinylsulfonylacetamide)ethane; active halides such as 2,4-dichloro-6-hydroxy-s-triazine sodium salt, 2,4-dichloro-6-methoxy-s-triazine, 2,4-dichloro-6-(4-sulfonylino)-s-triazine sodium salt, 2,4-dichloro-6-(2-sulfoethylamino)-s-triazine, and N,N'-bis(2-chloroethylcarbamyl)piperadine; epoxy compounds such as bis(2,3-epoxypropyl)methylpropyl ammonium p-toluenesulfonate salt, 1,4-bis(2',3'-epoxypropyloxy)butane, 1,3,5-triglycidyl isocyanurate, and 1,3-diglycidyl-5-(γ-acetoxy-β-oxypropyl) isocyanurate; ethyleneimine compounds such as 2,4,6-triethyleneimino-s-triazine, 1,6-hexamethylene-N,N'-bisethylene urea, and bis-β-ethyleneiminoethyl thioether; methanesulfonate esters such as 1,2-di(methanesulfonoxy)ethane, 1,4-di(methanesulfonoxy)butane, and 1,5-di(methanesulfonoxy)pentane; carbodiimides; isooxazoles; and inorganic compounds such as chromium alum.

Also included are matte agents which are, for example, methacrylate polymers such as polymethyl methacrylate homopolymer and methyl methacrylate/methacrylic acid copolymers, organic compounds such as starch, fine particulate inorganic compounds such as silica, titanium dioxide, strontium sulfate and barium sulfate as described in U.S. Pat. Nos. 2,992,101, 2,701,245, 4,142,894 and 4,396,706. A particle size of 1 to 10 μm, especially 2 to 5 μm is preferred.

The photographic photosensitive material used in the present invention includes a surface layer which may contain a slippage agent, for example, silicone compounds as described in U.S. Pat. Nos. 3,489,576 and 4,047,958, colloidal silica as described in JP-B 23139/1981, paraffin wax, higher fatty acid esters, starch derivatives and the like.

The photographic photosensitive material used in the present invention includes a hydrophilic colloid layer which may contain a plasticizer, for example, polyols such as trimethylol propane, pentane-diol, butane diol, ethylene glycol, and glycerine. The hydrophilic colloid layer may further contain a polymer latex for the purpose of improving pressure resistance. Examples of the polymer latex include alkyl acrylate homopolymers, acrylate copolymers, styrene-butadiene copolymers, and homopolymers and copolymers from monomers having an active methylene group.

In general, the photographic photosensitive material used in the present invention includes a silver halide photographic emulsion layer, intermediate layer, protective layer, anti-halation layer, back layer and any other necessary layer, which layers contain a binder. The binder may consist of the above-defined gelatin or a mixture thereof with another binder, for example, acylated gelatins such as phthalated gelatin and malonated gelatin, celluloses such as hydroxyethyl cellulose and carboxymethyl cellulose; soluble starches such as dextran; and hydrophilic polymers such as polyvinyl alcohol, polyvinyl pyrrolidone, polyacrylamide and polystyrene sulfonate. Mixtures of gelatin and dextran or polyacrylamide are preferred.

As mentioned above, the photographic silver halide photosensitive material used in the present invention may include in addition to the photosensitive silver halide emulsion layer, non-photosensitive layers such as surface protective, intermediate, anti-halation, and back layers.

More than one silver halide emulsion layer may be included and they may be different in sensitivity and gradation. It is also possible to provide one or more silver halide emulsion layers and one or more non-photosensitive layers on each side of a support.

The support used herein includes polyethylene terephthalate (PET) films and cellulose triacetate films, which are preferably colored blue. For improving its adhesion to the hydrophilic colloid layer, the support is preferably treated on the surface by corona discharge, glow discharge, or ultraviolet radiation exposure. Alternatively, the support may be provided with an undercoat layer of styrene butadiene latex, vinylidene chloride latex or the like and further with a gelatin layer thereon. Instead, an undercoat layer may be formed by coating a composition containing a polyethylene swelling agent and gelatin in an organic solvent. These undercoat layers may be surface treated for further improving adhesion to the hydrophilic colloid layer.

In the photosensitive material, there are generally contained anti-halation dyes and anti-irradiation dyes which are dyes having substantial absorption at longer wavelengths of 750 nm or more. More particularly, the anti-halation dyes are used in the intermediate, undercoat, anti-halation, back, emulsion and other layers while the anti-irradiation dyes are used in the intermediate and other layers as well as the emulsion layer. These dyes are preferably used in amounts of about $10^{-3}$ to 1 g/m$^2$, more preferably about $10^{-3}$ to 0.5 g/m$^2$. Preferred examples are described in U.S. Pat. Nos. 2,895,955, 3,177,078 and 4,581,325, and JP-A 100116/1975, 23148/1988 and 89838/1988. They may be used alone or in admixture of two or more.

Instead of or in combination with these dyes, other dyes may be used. Such substitute or additional dyes include the pyrazolone oxonol dyes described in U.S. Pat. No. 2,274,782, the diarylazo dyes described in U.S. Pat. No. 2,956,687, the styryl and butadienyl dyes described in U.S. Pat. Nos. 3,423,207 and 3,384,487, the merocyanine dyes described in U.S. Pat. No. 2,527,583, the merocyanine and oxonol dyes described in U.S. Pat. Nos. 3,486,897, 3,652,284 and 3,718,472, and the enaminohemioxonol dyes described in U.S. Pat. No. 3,976,661.

EXAMPLE

Examples of the present invention are given below by way of illustration and not by way of limitation.

EXAMPLE 1

Gelatin's Isoelectric Point

A gelatin was dissolved in distilled water to form a 10% aqueous solution, which was maintained at 40° C. and passed through an ion-exchange resin for removing contaminating salts. This purifying step was repeated several times until the gelatin solution became pure. The pH of the solution was measured at 40° C. and regarded as an isoelectric point.

Most alkali treated gelatins had pH values of 4.5 to 5.0, that is, lower isoelectric points. Most acid treated gelatins had pH values of 6.0 to 9.5, that is, higher isoelectric points. Some of the measurements are shown in Table 1.

TABLE 1

| Gelatin No. | Tradename | isoelectric point (pH) | Classification |
|---|---|---|---|
| 1 | #700 (Nitta K.K.) | 4.6 | Alkali treated |
| 2 | #680 (Nitta K.K.) | 4.8 | Alkali treated |
| 3 | #PS (Nippi K.K.) | 9.0 | Acid treated |
| 4 | #950 (Nitta K.K.) | 7.0 | Acid treated |
| 5 | #ABA (Nippi K.K.) | 6.6 | Acid treated |

1. Preparation of silver halide emulsion

In a container, 32 grams of each of gelatin Nos. 1 to 5 was dissolved in 1 liter of $H_2O$. To the container heated at 53° C., there were added 5 grams of sodium chloride, 0.3 grams of potassium bromide, and 46 mg of compound (*1) shown below. Then 400 ml of an aqueous solution containing 80 mg of silver nitrate and 415 ml of an aqueous solution containing 40 grams of potassium bromide and 8 grams of sodium chloride were added over about 25 minutes by the double jet method. Then 400 ml of an aqueous solution containing 80 grams of silver nitrate and 415 ml of an aqueous solution containing 40 grams of potassium bromide, 8 grams of sodium chloride, and $10^{-7}$ mol per mol of Ag of potassium hexachloroiridate (III) were added by the double jet method. In this way, there was prepared an emulsion of silver halide grains having a mean particle size (mean equivalent spherical particle diameter) of 0.35 μm.

Compound (*1):

-continued

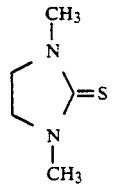

The emulsion was desalted, and 60 grams of each of the foregoing gelatins was added to the emulsion which was adjusted to pH 6.5 and pAg 8.5.

Then the emulsion was heated at 55° C., chemically sensitized by adding 2 mg of sodium thiosulfate and 3.4 mg of chloroauric acid. After 60 minutes, 250 mg of 4-hydroxy-6-methyl-1,3,3a,7-tetraazaindene and 1.8 grams of compound (*2) shown below were added to the emulsion, which was rapidly solidified.

Compound (*2):

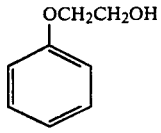

The resulting emulsions are designated emulsion Nos. 1 to 5 in accordance with gelatin Nos. 1 to 5.

2. Preparation of emulsion coating solution

An emulsion coating solution was prepared by charging a container with 850 grams of each of emulsion Nos. 1 to 5, heating it at 40° C., and adding the following additives thereto.

| Formulation | | |
|---|---|---|
| (a) | Emulsion (Nos. 1 to 5) | 850 g |
| (b) | Spectral sensitizing dye (*3) | $1.2 \times 10^{-4}$ mol |
| (c) | Supersensitizer (*4) | $0.8 \times 10^{-3}$ mol |
| (d) | Storage improver (*5) | $1 \times 10^{-3}$ mol |
| (e) | Polyacrylamide (MW 40,000) | 7.5 g |
| (f) | Trimethylol propane | 1.6 g |
| (g) | Polystyrene sulfonate Na | 2.4 g |
| (h) | Poly(ethyl acrylate/methacrylic acid) latex | 16 g |
| (i) | N,N'-ethylenebis(vinylsulfonacetamide) | 1.2 g |

Spectral sensitizing dye (*3):

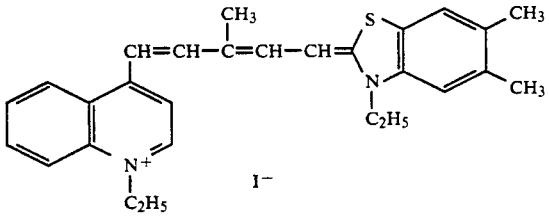

-continued

Supersensitizer (*4):

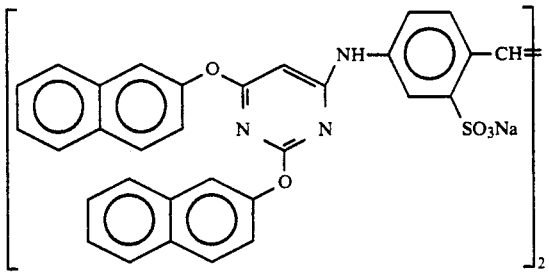

Storage improver (*5):

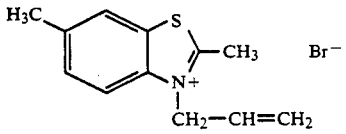

3. Preparation of emulsion surface protective layer coating solution

A coating solution for forming a surface protective layer on the emulsion layer was prepared by adding the following additives to a container heated at 40° C.

| Formulation | | |
|---|---|---|
| (a) | Gelatin (Nos. 1 to 5) | 100 g |
| (b) | Polyacrylamide (MW 40,000) | 10 g |
| (c) | Polystyrene sulfonate Na (MW 600,000) | 0.6 g |
| (d) | N,N'-ethylenebis(vinylsulfonacetamide) | 1.5 g |
| (e) | Polymethyl methacrylate fine particles (mean particle size 2.0 μm) | 2.2 g |
| (f) | Na t-octylphenoxyethoxyethane sulfonate | 1.2 g |
| (g) | $C_{16}H_{33}O-(CH_2CH_2O)_{10}-H$ | 2.7 g |
| (h) | Sodium polyacrylate | 4 g |
| (i) | $C_8F_{17}SO_3K$ | 70 mg |
| (j) | $C_8F_{17}SO_2N(C_3H_7)(CH_2CHO)_4(CH_2)_4-SO_3Na$ | 70 mg |
| (k) | NaOH (1N) | 4 ml |
| (l) | Methanol | 60 ml |
| (m) | Preservative (*6) | 50 mg |

Preservative (*6):

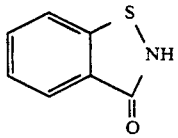

4. Preparation of back layer coating solution

A coating solution for forming a back layer was prepared by adding the following additives to a container heated at 40° C.

| Formulation | | |
|---|---|---|
| (a) | Gelatin (Nos. 1 to 5) | 80 g |
| (b) | Dye (*7) | 3.1 g |
| (c) | Polystyrene sulfonate Na | 0.6 g |
| (d) | Poly(ethyl acrylate/methacrylic acid) latex | 15 g |
| (e) | N,N'-ethylenebis (vinylsulfonacetamide) | 4.3 g |
| (f) | Preservative (*6) | 50 mg |

Dye (*7):

-continued

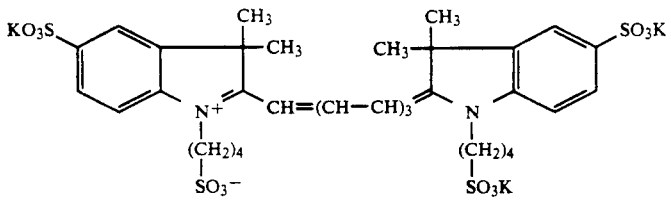

5. Preparation of back surface protective layer coating solution

A coating solution for forming a surface protective layer on the back layer was prepared by adding the following additives to a container heated at 40° C.

| Formulation | |
|---|---|
| (a) Gelatin (Nos. 1 to 5) | 80 g |
| (b) Polystyrene sulfonate Na | 0.3 g |
| (c) N,N'-ethylenebis(vinylsulfonacetamide) | 1.7 g |
| (d) Polymethyl methacrylate fine particles (mean particle size 4.0 μm) | 4 g |
| (e) Na t-octylphenoxyethoxyethane sulfonate | 3.6 g |
| (f) NaOH (1N) | 6 ml |
| (g) Sodium polyacrylate | 2 g |
| (h) $C_{16}H_{33}O—(CH_2CH_2O)_{10}—H$ | 3.6 g |
| (i) $C_8F_{17}SO_3K$ | 50 mg |
| (j) $C_8F_{17}SO_2N(C_3H_7)(CH_2CHO)_4(CH_2)_4—SO_3Na$ | 50 mg |
| (k) Methanol | 130 ml |
| (l) Preservative (*6) | 50 mg |

6. Preparation of coated sample

A PET support on one surface was coated with the back layer coating solution together with the back layer surface protective layer coating solution to give a total gelatin coverage of 3 g/m². Thereafter, the support on the other surface was coated with the emulsion coating solution together with the emulsion layer surface protective layer coating solution, forming an emulsion layer with a silver coverage of 2.5 g/m² and a surface protective layer with a gelatin coverage of 1 g/m² thereon.

In this way, there were-obtained coated sample Nos. 1 to 5 in accordance with gelatin Nos. 1 to 5.

7. Preparation of developer concentrate

A developer concentrate was prepared in accordance with the following formulation.

| | |
|---|---|
| Potassium hydroxide | 57.5 g |
| Sodium sulfite | 87.5 g |
| Potassium sulfite | 110 g |
| Diethylenetriamine pentaacetate | 5 g |
| Boric acid | 25 g |
| Potassium carbonate | 32.5 g |
| Hydroquinone | 87.5 g |
| Diethylene glycol | 125 g |
| 4-hydroxymethyl-4-methyl-1-phenyl-3-pyrazolidone | 10 g |
| 5-methylbenzotriazole | 0.15 g |
| 2,3,5,6,7,8-hexahydro-2-thioxo-4(1H)quinazolinone | 0.25 g |
| Sodium 2-mercaptobenzoimidazole-5-sulfonate | 0.35 g |
| Potassium bromide | 7.5 g |
| Water totaling to | 1000 ml |
| pH adjusted to | 11.0 |

A working developer solution was prepared by diluting 400 ml of the concentrate with 600 ml of water.

8. Preparation of fixer concentrate

Four fixer concentrates were prepared in accordance with formulations A, B, C and D shown in Table 2. A, B and C are outside the scope of the invention, with only D being within the scope of the invention.

TABLE 2

| Formulation | A | B | C | D |
|---|---|---|---|---|
| Ammonium thiosulfate | 280 g | 280 g | — | — |
| Sodium thiosulfate | — | — | 299 g | 229 g |
| Sodium sulfite | 30 g | 30 g | 30 g | 30 g |
| 2Na-EDTA dihydrate | 0.05 g | 0.05 g | 0.05 g | 0.05 g |
| Acetic acid | 60 g | — | 60 g | — |
| Glycerin | — | — | 20 g | 20 g |
| Water | 1000 ml | 1000 ml | 1000 ml | 1000 ml |
| pH | 4.5 | 6.0 | 4.5 | 6.0 |

The pH of the concentrates was adjusted with sodium hydroxide or acetic acid.

A working fixer solution was prepared by diluting 500 ml of the concentrate with 500 ml of water (concentrate/water volume ratio=1/1).

Using a modified one of commercial automatic processor, model FPM-200 (manufactured by Fuji Photo-Film Co., Ltd.), coated sample Nos. 1 to 5 were processed on a dry-to-dry 30-second processing schedule (development 6.4 sec., fixation 6.8 sec., washing 4.1 sec., squeezing 3.9 sec. and drying 8.3 sec.).

The detail of this processing is as follows. The coated samples were allowed to stand for 7 days at a temperature of 25° C. and a relative humidity of 60% after coating, and subjected to scanning exposure for $10^{-7}$ sec. at room temperature using a semiconductor laser of 780 nm. The developing temperature was 35° C., the fixing temperature was 32° C., and the replenishing amount was 25 ml per sheet of 36.4×25.7 cm for both of the developer and fixer. Washing used city water at 20° C. The drying temperature was 55° C. In each test 600 sheets (36.4×25.7 cm) were processed.

After processing, fixation, drying and odor were evaluated as follows. Fixation was evaluated by visually observing the processed photosensitive material. Drying was evaluated by touching the processed photosensitive material with fingers. As to the odor, the processor interior at the end of processing was examined for sulfur dioxide and ammonia gas concentrations by means of gas detectors ($SO_2$: detector tube manufactured by Gas Tech K.K., $NH_3$: detector tube manufactured by Komei Rikagaku Kogyo K.K.) and at the same time, the odor was actually smelt for perceiving acetic acid odor. The results are shown in Table 3. For $SO_2$, a level of up to 1 ppm was regarded as raising no odor problem. For $NH_3$, a level of up to 0.1 ppm was regarded as raising no odor problem and represented as "nil". "Odor evaluation" was marked "○" when all the items were acceptable and "X" when any of the items was unacceptable.

TABLE 3

| Test No. | Coated sample No. | Isoelectric point of gelatin used | Fixer | Fixation | Dryness | Odor | | | |
|---|---|---|---|---|---|---|---|---|---|
| | | | | | | $SO_2$ (ppm) | $NH_3$ (ppm) | Acetic acid odor | Evaluation |
| 1 (Comparison) | 1 | 4 · 6 | A | OK | x Poorly dry at 200th | 20 | 49 | Smelt | x |
| 2 (Comparison) | 1 | 4 · 6 | B | OK | Δ Poorly dry at 400th | 1 | 135 | No | x |
| 3 (Comparison) | 1 | 4 · 6 | C | OK | x Poorly dry at 150th | 19 | nil | Smelt | x |
| 4 (Comparison) | 1 | 4 · 6 | D | OK | Δ Poorly dry at 420th | 1 | nil | No | ○ |
| 5 (Comparison) | 2 | 4 · 8 | A | OK | x Poorly dry at 240th | 25 | 52 | Smelt | x |
| 6 (Comparison) | 2 | 4 · 8 | B | OK | Δ Poorly dry at 420th | 1 | 129 | No | x |
| 7 (Comparison) | 2 | 4 · 8 | C | OK | x Poorly dry at 170th | 29 | nil | Smelt | x |
| 8 (Comparison) | 2 | 4 · 8 | D | OK | Δ Poorly dry at 440th | 2 | nil | No | ○ |
| 9 (Comparison) | 3 | 9 · 0 | A | OK | Δ Poorly dry at 470th | 31 | 49 | Smelt | x |
| 10 (Comparison) | 3 | 9 · 0 | B | OK | ○ Fully dry over 600 | 1 | 115 | No | x |
| 11 (Comparison) | 3 | 9 · 0 | C | OK | Δ Poorly dry at 480th | 28 | nil | Smelt | x |
| 12 (Invention) | 3 | 9 · 0 | D | OK | ○ Fully dry over 600 | 0 | nil | No | ○ |
| 13 (Comparison) | 4 | 7 · 0 | A | OK | Δ Poorly dry at 450th | 27 | 58 | Smelt | x |
| 14 (Comparison) | 4 | 7 · 0 | B | OK | ○ Fully dry over 600 | 1 | 149 | No | x |
| 15 (Comparison) | 4 | 7 · 0 | C | OK | Δ Poorly dry at 470th | 26 | nil | Smelt | x |
| 16 (Invention) | 4 | 7 · 0 | D | OK | ○ Fully dry over 600 | 0 | nil | No | ○ |
| 17 (Comparison) | 5 | 6 · 6 | A | OK | Δ Poorly dry at 410th | 33 | 47 | Smelt | x |
| 18 (Comparison) | 5 | 6 · 6 | B | OK | ○ Fully dry over 600 | 2 | 128 | No | x |
| 19 (Comparison) | 5 | 6 · 6 | C | OK | Δ Poorly dry at 460th | 29 | nil | Smelt | x |
| 20 (Invention) | 5 | 6 · 6 | D | OK | ○ Fully dry over 600 | 0 | nil | No | ○ |

As seen from Table 3,Test Nos. 12, 16 and 20 falling within the scope of the present invention provided satisfactory fixation, satisfactory drying, substantially no generation of sulfur dioxide and ammonia gases, and no acetic acid odor.

The fixer concentrate within the scope of the present invention (fixer concentrate D) was found to form no sulfide during shelf storage over 12 months in concentrate form, indicating improved shelf stability. In contrast, fixer concentrate C was less shelf stable since precipitates formed after 2 months.

EXAMPLE 2

Using coated sample Nos. 1, 3 and 5 and fixer concentrates A to D in Example 1, the following test was carried out. In the processor FPM-2000 used in Example 1, rinsing units each consisting of a rinsing tank and two pairs of rinsing rollers were located between the developing and fixing tanks and between the fixing and washing tanks as shown in FIG. 1. The rinsing tanks were filled with water and replenished with a suitable amount of water as photosensitive material was successively processed. The processing speed was 30 and 70 seconds on a dry-to-dry basis. The schedule is shown in Table 4.

TABLE 4

| | Processing schedule on dry-to-dry basis | |
|---|---|---|
| | 30 seconds | 70 seconds |
| Development | 6 sec. 35° C. | 14 sec. 35° C. |
| Rinsing | 0.5 sec. 20° C. | 1.2 sec. 20° C. |
| Fixation | 6.5 sec. 34° C. | 15.2 sec. 34° C. |
| Rinsing | 0.5 sec. 20° C. | 1.2 sec. 20° C. |
| Washing | 4 sec. 20° C. | 9.3 sec. 20° C. |
| Squeezing | 4 sec. | 9.3 sec. |
| Drying | 8.5 sec. 55° C. | 19.8 sec. 50° C. |

Under these conditions, the procedure of Example 1 was repeated. Equivalent results were obtained.

EXAMPLE 3

Coated samples were prepared in the same manner as coated sample Nos. 3 to 5 in Example 1 except that the gelatins used in the back layer coating solution and the back surface protective layer coating solution were changed to gelatin No. 2 in Table 1. These samples are designated coated sample Nos. 6 to 8 in correspondence with coated sample Nos. 3 to 5.

The coated samples were processed as in Example 1, obtaining equivalent results.

EXAMPLE 4

Coated samples were prepared in the same manner as coated sample Nos. 3 to 5 in Example 1 except that the gelatins used in the emulsion coating solution, the back layer coating solution and the back surface protective layer coating solution were changed to gelatin No. 2 in Table 1. These samples are designated coated sample Nos. 9 to 11. Therefore, coated sample Nos. 9 to 11 used the acid treated gelatin in only the emulsion layer surface protective layer coating solution.

The coated samples were processed as in Example 1, obtaining good results equivalent to Test Nos. 12, 16 and 20.

EXAMPLE 5

A monodisperse silver chlorobromide emulsion having a mean grain size of 0.15 μm was prepared by simultaneously adding an aqueous solution of silver nitrate and an aqueous solution of sodium chloride and sodium bromide containing $3\times10^{-8}$ mol of $K_3IrCl_6$ and $3\times10^{-7}$ mol of $(NH_4)_3RhCl_6$ per mol of silver to an aqueous solution of gelatin (No. 2 in Table 1) at 40° C. over 30 minutes while maintaining a potential of 200 mV. An aqueous solution containing 0.1 mol % of potassium iodide per mol of silver in the emulsion was added to the emulsion for conversion. After desalting by flocculation, the emulsion was dispersed in the same gelatin as above, obtaining an emulsion ($AgCl_{69.9}Br_{30}I_{0.1}$, dispersion factor 10%).

Hypo and N,N-dimethylselenourea were added to the emulsion which was maintained at 60° C. for chemical ripening. To the emulsion was added a 1% solution of 4-hydroxy-6-methyl-1,3,3a,7-tetraazaindene in an amount of 30 ml per mol of silver.

For sensitization in the infrared region, 60 ml of a 0.05% solution of infrared sensitizing dye (*3) was added to 1 kg of the emulsion. Then for supersensitization and stabilization, 50 ml of a 0.5% methanol solution of disodium 4,4'-bis-[4,6-di(naphthoxy-pyrimidin-2-ylaminol-stilbene-2,2'-disulfonate, 90 ml of a 0.5% methanol solution of 2,5-dimethyl-3-allyl-benzothiazole iodide, and 15 ml of a 1% aqueous solution of potassium bromide were added to the emulsion. The final emulsion silver halide grains had a mean grain size of 0.2 μm.

IR sensitizing dye (*3):

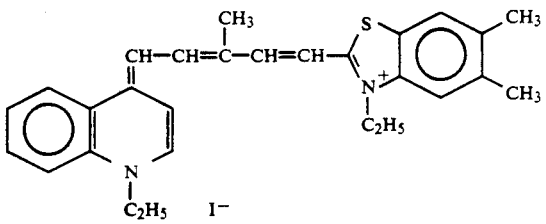

To the emulsion were added 100 mg/m² of hydroquinone, 25% by weight of the gelatin binder of polyethyl acrylate as a polymer latex, and 2-bis(vinylsulfonylacetamide)ethane as a harder. The solution was coated on a PET support to form an emulsion layer on one surface thereof having a silver coverage of 3.5 g/m² and a gelatin (No. 2 in Table 1) coverage of 1.3 g/m².

A protective layer and a back layer were simultaneously coated on the emulsion layer and the support back surface, respectively. The protective layer contained 0.6 g/m² of gelatin (No. 3 in Table 1), 60 mg/m² of polymethyl methacrylate of 3–4 μm in particle size as a matter agent, 40 mg/m² of colloidal silica of 10–20 mμ in particle size, 100 mg/m² of silicone oil, 20 mg/m² of dye (*8), and 10 mg/m² of dye (*9), while sodium dodecylbenzenesulfonate and fluorinated surfactant (*10) were used as coating aids. The back layer contained 0.7 g/m² of gelatin (No. 2 in Table 1) 225 mg/m² of polyethyl acrylate latex, 70 mg/m² of a dye (*9), and 40 mg/m² of polymethyl methacrylate of 5 μm in particle size as a matter agent, while sodium dodecylbenzenesulfonate and 2 mg/m² of fluorinated surfactant (*10) were used as coating aids.

Dye (*8):

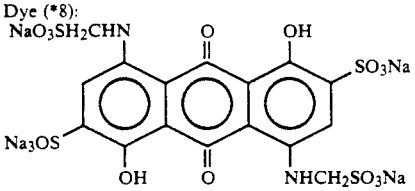

Dye (*9):

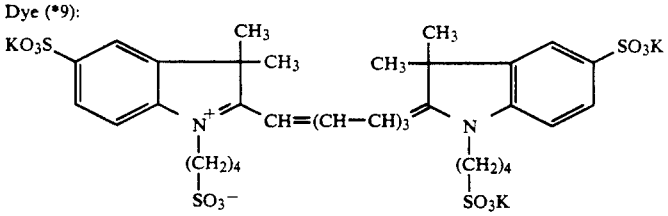

Fluorinated surfactant (*10):

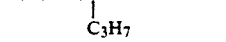

Photosensitive material in sheet (20×24 inches) form was prepared in this way. Without exposure, sheets of photosensitive material were processed with the developer and fixer used in Example 1, using the same processor as in Example 1 under the following conditions. The fixing and washing tanks in the processor were of the same configuration having seven pairs of opposed rollers.

| Processing conditions | |
|---|---|
| Fixing time | 10 sec. at 37° C. |
| Line speed | 27 mm/sec. |
| Fixer circulating speed | 48 m/min. |
| Fixer circulating quantity | 54% |
| Rollers | 7 pairs |

Development was 15 sec. at 38° C. and the dry-to-dry processing time was 50 seconds. Both the developing and fixing tanks had a volume of 10 liters.

The fixer contained sodium thiosulfate in a concentration of 1.27 mol/liter.

As the photosensitive material was processed, the processor tanks were replenished in predetermined rates. The developer and fixer replenishers were the same as the developer and fixer tank solutions, respectively. In this replenishment mode, 500 sheets (20×24 inches) were processed. Evaluation was made as in Example 1.

The results are as good as Test Nos. 12, 16 and 20 in Example 1.

The photosensitive material processing method of the present invention provides improved rapid processing with increased degrees of fixation and drying while preventing the generation of sulfur dioxide and ammonia gases, thus ensuring an acceptable working environment.

While there has been described herein what is considered to be a preferred embodiment of the present invention, other modifications of the invention shall be aparent to those skilled in the art from the teachings herein, and it is, therefore, desired to be secured in the appended claims all such modifications as fall within the true spirit and scope of the invention.

We claim:

1. A method for processing a photographic silver halide photosensitive material having at least one silver halide emulsion layer on a support after exposure comprising the step of treating the material with a working fixer solution, wherein said working fixer solution is prepared by furnishing a fixer concentrate of at least pH 5 containing a thiosulfate as a fixing agent, 0.05 to 0.8 mol/-liter of a sulfite and up to 0.01 mol/liter of a water-soluble aluminum salt, and diluting the fixer concentrate with water at a volume ratio of water to the concentrate of at least 0.5/1, thereby forming the working fixer solution containing up to 0.1 mol/liter of ammonium thiosulfate and 0.5 to 2.5 mol/liter of sodium thiosulfate; and said photosensitive material contains at least 10% by weight of a gelatin having an isoelectric point of at least 5.0 on the same side thereof as the emulsion layer with respect to the support, in percent by weight of gelatins on the emulsion layer side.

2. The processing method of claim 1 wherein said working fixer solution is substantially of sodium thiosulfate.

3. The processing method of claim 1 wherein said photosensitive material has at least one silver halide emulsion layer containing silver halide grains having a mean equivalent spherical diameter of up to 0.6 μm, is sensitive to radiation in the wavelength range of 600 to 800 nm, and adapted to be exposed to a light source in the form of a semiconductor laser.

4. The processing method of claim 1 which is carried out in an automatic processor including a developing tank, a fixing tank, a washing tank, a first rinsing tank between the developing and fixing tanks, and a second rinsing tank between the fixing and washing tank.

* * * * *